US006783128B2

(12) United States Patent
Casey et al.

(10) Patent No.: US 6,783,128 B2
(45) Date of Patent: Aug. 31, 2004

(54) BASEBALL-RELATED CARD GAME AND METHOD

(76) Inventors: Gerald A. Casey, 329 S. 177th Pl. Apt. E 302, Seattle, WA (US) 98148; Greg Mills, N18 W28935 Golf Ridge South, Pewaukee, WI (US) 53072

( * ) Notice: Subject to any disclaimer, the term of this patent is extended or adjusted under 35 U.S.C. 154(b) by 0 days.

(21) Appl. No.: 10/160,612

(22) Filed: May 30, 2002

(65) Prior Publication Data

US 2002/0180153 A1 Dec. 5, 2002

Related U.S. Application Data

(60) Provisional application No. 60/295,066, filed on May 31, 2001.

(51) Int. Cl.[7] ..... A63F 1/00

(52) U.S. Cl. ..... 273/298; 273/274; 273/244.1

(58) Field of Search ..... 273/292, 298, 273/309, 274, 244.1, 244, 259, 277, 308

(56) References Cited

U.S. PATENT DOCUMENTS 4,141,548 A 2/1979 Everton
4,429,877 A * 2/1984 Coppock ..... 273/139
4,759,549 A * 7/1988 Beckwith ..... 273/274
4,776,593 A 10/1988 DiPersio et al.
5,407,204 A * 4/1995 Meyer, III ..... 273/244.2
5,522,590 A 6/1996 Moran
5,730,443 A 3/1998 Allen
5,769,714 A 6/1998 Wiener et al.
5,782,470 A * 7/1998 Langan ..... 273/139
5,884,914 A * 3/1999 Lilien ..... 273/244.1
6,527,270 B2 * 3/2003 Maksymec et al. ..... 273/138.1

* cited by examiner

*Primary Examiner*—Vishu K. Mendiratta
(74) *Attorney, Agent, or Firm*—Dean A. Craine

(57) ABSTRACT

A card game that is played by spectators watching or listening to a live baseball game. The game consists of a deck of cards equally distributed between two to nine players. Each card is associated with one of nine possible specific end batting events that can occur to a batter when batting. Prior to the first pitch, the card players examine their cards and consider the likelihood that the action or event depicted on one of their cards will occur to the next batter, taking into consideration the skill of the batter, the pitcher, and the game situation. The card player who holds the card that matches the actual action or end batting event that occurs to the batter, wins the round. The cards are then reshuffled and distributed to the card players before the first pitch is delivered to the next batter.

6 Claims, 3 Drawing Sheets

BASEBALL-RELATED CARD GAME AND METHOD

This is a utility patent application based on a provisional patent application (Serial No. 60/295,066) filed on May 31, 2001.

BACKGROUND OF THE INVENTION

1. Field of the Invention

This invention pertains to card games, and more particularly, to baseball-related card games which participants play while watching or listening to a baseball game.

2. Description of the Related Art

Baseball is one of the most favorite team sports played or watched in the United States and Japan. Thousands of games are played in front of millions of fans in stadiums, on television, on radio and, more recently, over the World Wide Web.

While the game of baseball is a relatively simple sport, the advanced skill levels of professional players and the individual match-ups between the pitcher and hitters adds excitement to the game for baseball enthusiasts. There are games, however, that are slow and sometimes boring to some spectators. This is especially true for part-time baseball enthusiasts and to young fans who come to the game to catch a fly ball or receive a free T-shirt.

Today, many ballparks have large display screens located above the grandstand and overlooking the outfield. During the game, the displays are used to show a photograph or statistics for the player currently at bat or on deck, or to show a replay of an event that just occurred on the field. In between innings, the displays are often used to show humorous film clips or short video contests that spectators are encouraged to watch to predict the answer or winner.

What is needed is an entertainment device for spectators that enables them to watch and participate in a live or recorded baseball game.

SUMMARY OF THE INVENTION

It is an object of the present invention to provide a card game played by spectators as they watch a baseball game.

It is another object of the present invention to provide such a card game that is simple to play and easy to learn by novice and expert baseball fans.

It is another object of the present invention to provide such a card game that uses the "live" action of the players during the baseball game.

It is another object of the present invention to provide such a game that can be played the ballpark where the game is played or at a remote location in front of a television, radio, or computer.

These and other objects of the invention that will become apparent are met by a baseball-related card game played by individuals watching or listening to a baseball game. The game consists of a deck of nine cards with one of nine possible baseball-related actions or events that can occur to a batter when batting printed on their front surface. Prior to the first pitch to a batter, the deck of cards is evenly distributed among two to nine card players. The card players examine their cards and consider the likelihood that the end batting event depicted on the face of one of their cards will occur for the next batter, taking into consideration the skill of the batter, the pitcher, and the game situation. The card player who holds the card that matches the end batting event that eventually occurs to the batter, wins the round. The cards are then reshuffled and distributed to the card players before the first pitch is delivered to the next batter.

An optional betting opportunity may be used with the game in which the card players are given an opportunity to place a wager against the other card players that they hold a card that depicts the upcoming end batting event.

DESCRIPTION OF THE PREFERRED EMBODIMENT(S)

Figure 1:
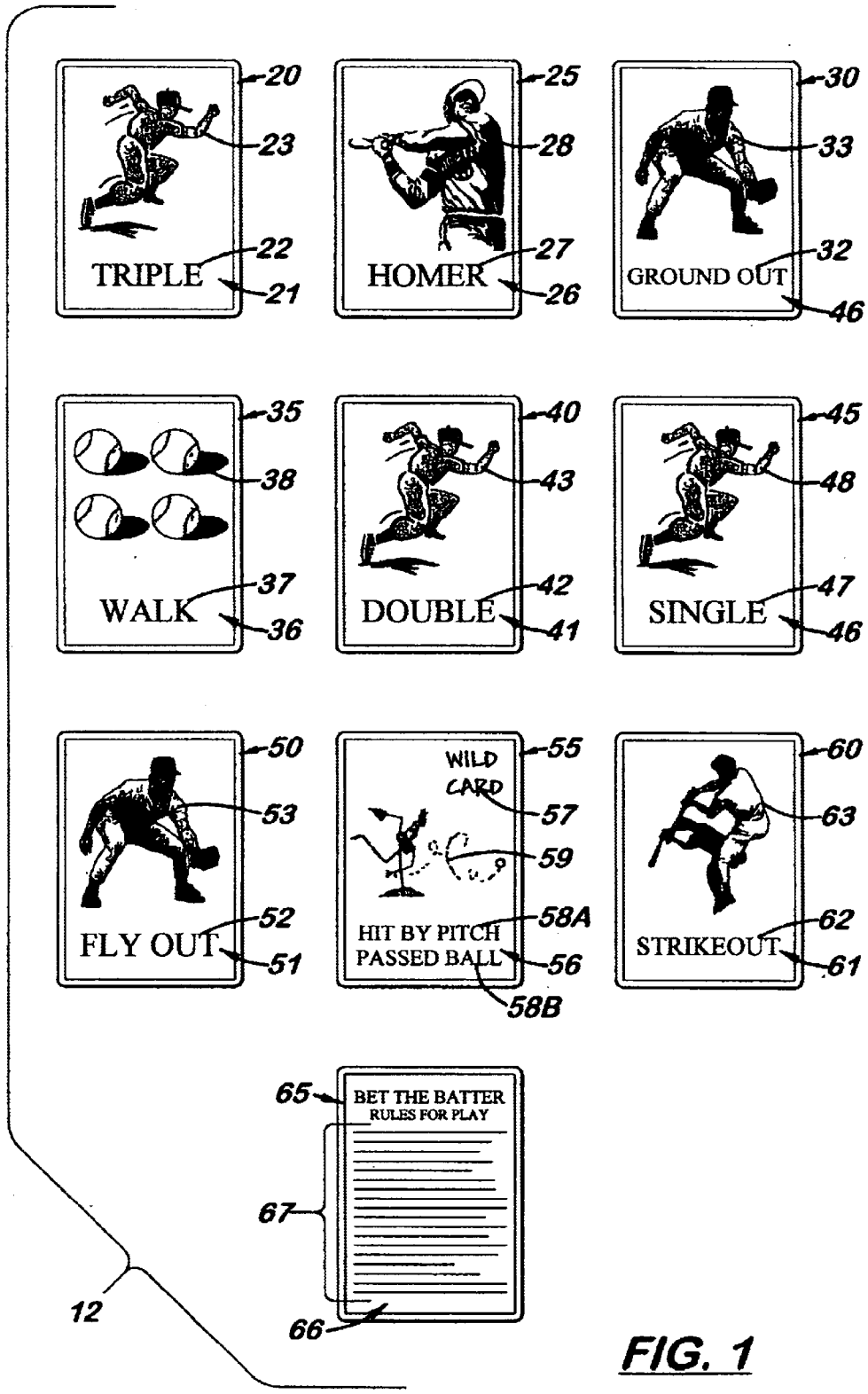
FIG. 1 is a front plan view of the card game disclosed herein.
Figure 2:
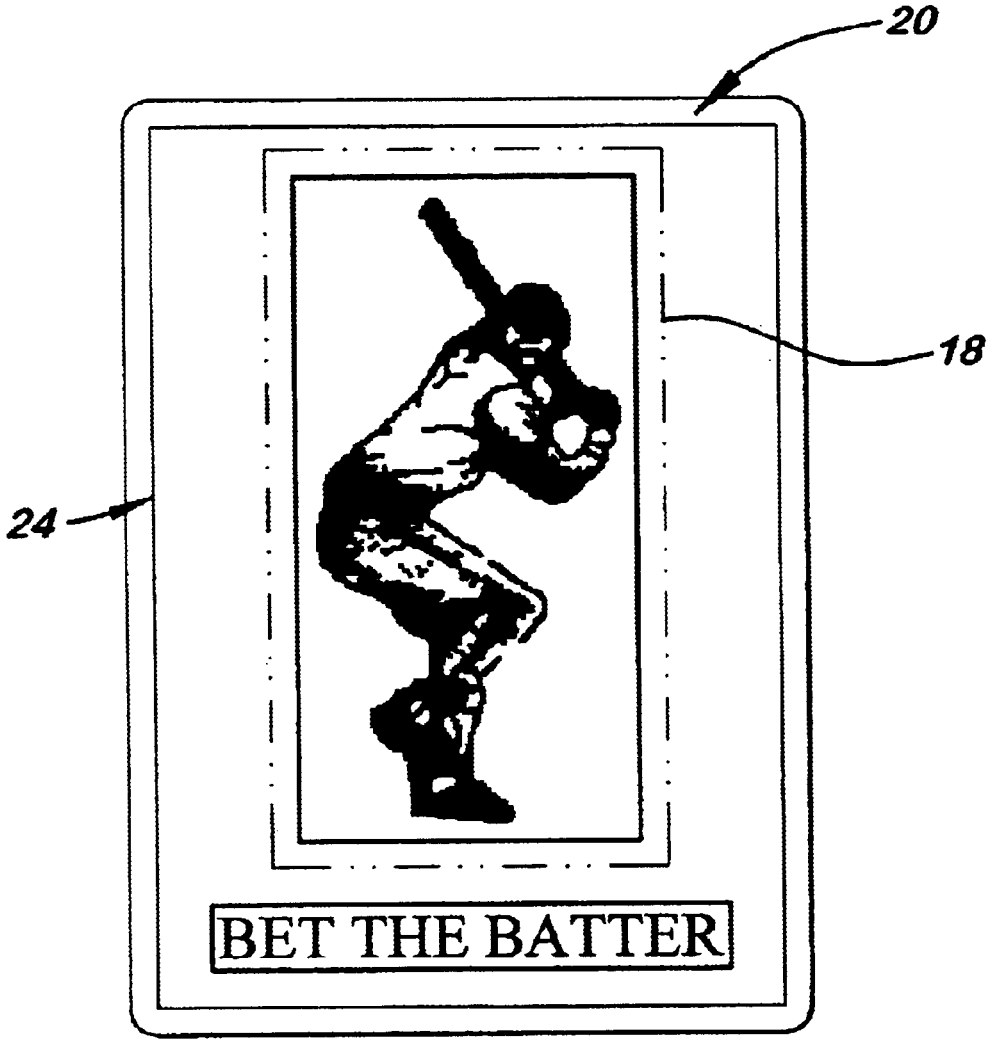
FIG. 2 is a rear plan view of one card used in the card game.
Figure 3:
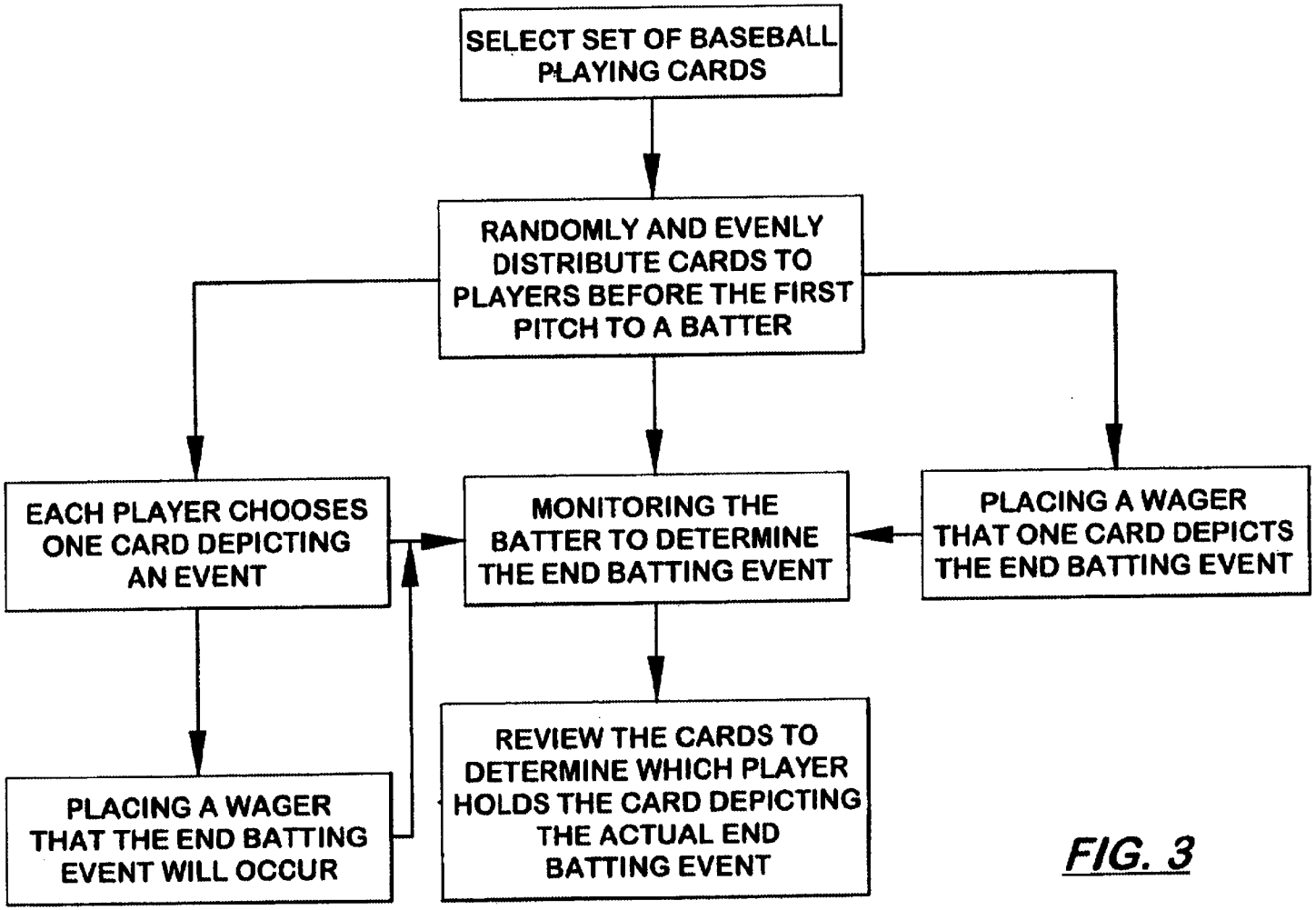
FIG. 3 is a flow chart diagram of the method of playing the card game.

Referring to the accompanying FIGS. 1–3, there is shown and described a baseball-related card game and method 12 played by spectators watching or listening to a live or prerecorded baseball game. 1The card game 12 includes a deck of nine cards 20, 25, 30, 35, 40, 45, 50, 55, and 60 equally distributed between two to nine players. Displayed on one surface of each card 20, 25, 30, 35, 40, 45, 50, 55, 60, is one of nine possible specific end batting events that can occur to a batter when batting during a baseball game.

More specifically, the card game 12 includes the following end batting events:

(a) a first card 20 having a front surface 21 with the word "TRIPLE" 22 and an optional graphic 23 showing a player running;

(b) a second card 25 having a front surface 26 with the word "HOMER" 27 and a graphic 28 showing a batter completing a swing of the bat;

(c) a third card 30 has a front surface 31 with the phrase "GROUND OUT" 32 and an optional graphic 33 showing a player fielding a baseball;

(d) a fourth card 35 has a front surface 36 with the word "WALK" 37 and an optional graphic 38 showing four baseballs;

(e) a fifth card 40 has a front surface 41 with the word "DOUBLE" 42 and an optional graphic 43 showing a player running;

(f) a sixth card 45 has a front surface 46 with the word "SINGLE" 47 and an optional graphic 48 showing a player running;

(g) a seventh card 50 has a front surface 51 with the phrase "FLY OUT" 52 and an optional graphic 53 of a player fielding a baseball;

(h) an eighth card 55 has a front surface 56 with the phrases "WILD CARD" 57, "HIT BY PITCH" 58(A) and "PASSED BALL" 58(B) and an optional graphic 59 of the pitcher throwing a curveball; and, (i) a ninth card 60 has a front surface 61 with the word "STRIKEOUT" 62 and an optional graphic 63 showing a batter swinging at a pitched ball.

The card game 12 may also include an optional card 65 with a printed set of instructions 67 on its front surface 66.

In the preferred embodiment, each card 20, 25, 30, 35, 40, 45, 50, 55, 60, and 65 is approximately 3 inches in height and 2 inches in width and made of water or moisture resistant material, such as plastic, that resists folding and food or beverage spills. Also, as shown in FIG. 2, the back surface 24 of each card, (only first card 20 shown) may include baseball-related indicia 18 printed thereon.

FIG. 3 is a flow chart showing the method of playing the card game 12. A group of two to nine participants, called card players, are gathered at the ballpark where the game is played, or in front of a radio or television broadcasting the game. The deck of cards 20, 25, 30, 35, 40, 45, 50, 55, 60 is then selected by a designated dealer, who also acts as referee. The dealer then equally deals the cards 20, 25, 30, 35, 40, 45, 50, 55, 60, facedown, to the card players. If an uneven number of participants are playing, each card player is given the same number of cards. Extra cards are placed in a "dummy" hand. The card players then monitor the baseball game to determine which end batting event actually occurs. The card player who holds the card that matches the end batting event that occurs, wins the round. The cards 20, 25, 30, 35, 40, 45, 50, 55, 60 are then gathered together and shuffled and then dealt for the next batter.

When wagering is added to the card game 12, the card players must consider the likelihood that the end batting event depicted on one of their cards will occur before placing a wager. There are two wager versions of the game 12. The first wager version requires that each player privately examine their cards 20, 25, 30, 35, 40, 45, 50, 55, 60 and select one card from the group of cards dealt to them, and place a wager based on the likelihood that the end batting event depicted on the card will occur. The card player holding the card that matches the end batting event that occurs wins the round and the bet. If none of the cards held by the card players match the actual end batting event, the wager amounts may be left, or removed for the next round.

In the second wager version of the card game the card players privately examine their cards and hold all of their cards. The card players then place a bet according on the likelihood that they hold a card that depicts the end batting event. The main advantage of the second wagering is that a winner is declared for each round. It should be understood that with both versions the rules could provide that if none of other card players match the bet, the card player who originally placed the bet automatically wins the round without considering the end batting event. In still other versions of the game, the card players may be given opportunities to place additional bets after each pitch.

In order to win the bet, the card players must understand which end batting events are likely to occur, the skill of the batter, the pitcher, and the game situation. All of these factors make the game exciting to both novice and expert baseball fans.

The same referee may be used throughout the entire game, or card players may alternate being the referee.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A method of playing a baseball-related card game, comprising the following steps:

a. selecting a baseball game;

b. selecting at least two card players;

c. selecting a baseball-related card game consisting of nine playing cards with each said playing card associated with one unique end batting event that can occur to a batter while batting;

d. randomly and evenly distributing said playing cards to said card players before a first pitch is delivered to said batter;

e. monitoring the baseball game to determine the end batting event for said batter; and, f. reviewing the cards dealt to said card players to determine which card player is holding the playing card depicting the end batting event.

2. The method of playing a baseball-related card game, as recited in claim 1, further including the step of placing a wager after said playing cards are dealt and before said end batting event occurs.

3. The method of playing a baseball-related card game, as recited in claim 1, wherein said end batting event is one of the following group of batting events: a strikeout, a walk, a single, a double, a triple, a homer, a ground out, and a fly out.

4. The method of playing a baseball-related card game, as recited in claim 3, wherein said group of end batting events includes a hit by a pitch.

5. The method of playing a baseball-related card game, as recited in claim 3, wherein said group of end batting events includes a passed ball.

6. The method of playing a baseball-related card game, as recited in claim 4, wherein said group of end batting events includes a passed ball.

* * * * *